United States Patent [19]

Gandini

[11] Patent Number: 4,969,217

[45] Date of Patent: Nov. 13, 1990

[54] DRAIN ASSEMBLY FOR SANITARY FIXTURE WITH BUILT-IN OVERFLOW DEVICE

[75] Inventor: Luigi Gandini, Cernusco Lombardone, Italy

[73] Assignee: American Standard Inc., New York, N.Y.

[21] Appl. No.: 343,554

[22] Filed: Apr. 27, 1989

[30] Foreign Application Priority Data

May 16, 1988 [IT] Italy ..... 46848 A/88

[51] Int. Cl.[5] ..... E03C 1/244

[52] U.S. Cl. ..... 4/200

[58] Field of Search ..... 4/197, 198, 200–202, 4/206

[56] References Cited

U.S. PATENT DOCUMENTS

| | | | |
|---|---|---|---|
| 263,180 | 8/1882 | Jackson | 4/198 |
| 328,180 | 10/1885 | Brady | 4/198 X |
| 332,911 | 12/1885 | Lane | 4/197 |
| 339,480 | 6/1886 | Schuyler | 4/198 X |
| 1,134,866 | 4/1915 | Kavanagh | 4/197 |
| 2,523,634 | 9/1950 | Pyle | 4/206 X |
| 3,315,279 | 4/1967 | Nolan | 4/198 |

FOREIGN PATENT DOCUMENTS

| | | | |
|---|---|---|---|
| 8403116 | 8/1984 | World Int. Prop. O. | 4/197 |

*Primary Examiner*—Charles E. Phillips

*Attorney, Agent, or Firm*—Blum Kaplan

[57] ABSTRACT

A drain assembly for a sanitary fixture with a built-in overflow device is disclosed. The sanitary fixture includes a main drain pipe, one end of which is mounted to the outlet opening thereof. The overflow device includes a conduit in the form of an inverted "U", each end of which is mounted, respectively, upstream and downstream of the stopper assembly which is mounted in the main drain pipe.

1 Claim, 1 Drawing Sheet

DRAIN ASSEMBLY FOR SANITARY FIXTURE WITH BUILT-IN OVERFLOW DEVICE

BACKGROUND OF THE DISCLOSURE

1. Field of the Invention

The present invention relates to a drain assembly for a sanitary fixture and, more particularly, a built-in overflow device operably coupled to the main drain conduit so as to prevent accidental overflow of the sanitary fixture.

2. Description of Prior Art

It is known that sanitary fixtures include overflow outlets formed in the upper section of the bowl wall which are connected to the main drain conduit below the stopper assembly for the sanitary fixtures, so that all overflow water bypasses the stopper assembly and enters the main drain conduit. The opening is made in the bowl wall after casting, if made of ceramic material, and in the metal wall when formed. In both instances, an enclosed channel connects the opening to the drain outlet. These additional steps require workers, time and equipment, which add cost to the fixture.

In addition, the overflow opening has proved to be relatvely disadvantageous, both in terms of esthetic appearance and because encrustations and dirt are readily deposited in it and are relatively difficult to clean.

SUMMARY OF THE INVENTION

The prinicpal object of this invention is to provide a drain assembly which is capable of performing the overflow functions for the corresponding fixture in which it is applied, without the need to make openings in the wall thereof.

Another object of the invention is to provide a drain assembly equipped with an overflow device, which shows no visible parts in the cavity or bowl of the sanitary fixture.

These objects are attained in the context of a simple and rational design solution. According to the invention, the drain assembly comprises a built-in overflow device whose ends are connected to the main drain pipe in juxtaposition with the drain outlet of the sanitary fixture and the other end, and to the siphon, not shown, and between which is mounted a remotely-operated stopper assembly.

In addition, there is provided, according to the invention, a secondary drain pipe which is placed to one side of the said main pipe, the ends of which are coupled thereto, respectively, upstream and downstream from the stopper. Also, the secondary pipe has a curved section with the concavity facing downward, located above the outlet opening of the sanitary fixture and positioned below the level of the rim of the bowl or the lower level of the opening of the corresponding fitting.

Lastly, according to an advantageous characteristic of the invention, the secondary pipe can be adjusted with respect to the main pipe so that the built-in overflow device lends itself to applicaiton to articles of different types. For example, the invention is suitable for sinks, bidets and washbasins, as well as for use on other items, for example, bathtubs.

DETAILED DESCRIPTION OF THE PREFERRED EMBODIMENT

Figure 1:
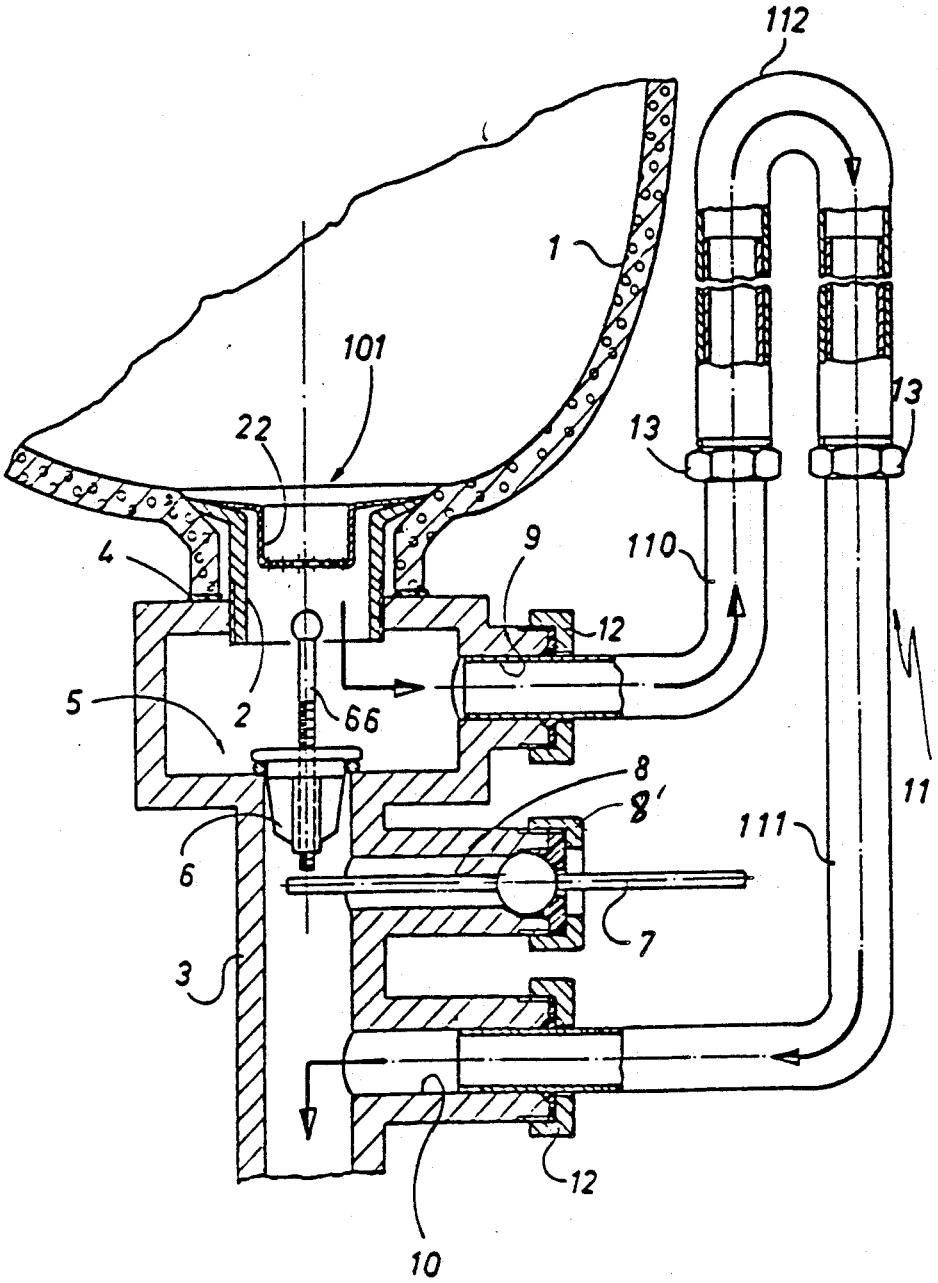
FIG. 1 is a view in elevation, partly in section, of the drain assembly, including a built-in overflow device mounted to the drain outlet of a sanitary fixture, such as a sink.

The design characteristics and merits of the invention will be evident from the following detailed description of FIG. 1, illustrating the invention according to one particular and preferred embodiment, such as a section of a sink.

Shown in FIG. 1 is sanitary fixture 1 having a drain hole or outlet 101 in which the drain assembly, including the built-in overflow device, is mounted. According to the invention, it is no longer necessary to make the usual overflow hole in the fixture, for example, a sink.

A bushing 2 is fitted in drain outlet 101 of fixture 1, the lower end of which is externally threaded and projects below outlet 101, onto which a drain pipe 3 is threaded. At the top of bushing 2, an external circumferential flange nests against the surface surrounding the opening of hole 101 to provide a seal between pipe 3 and fixture 1. A gasket 4 is provided between the flange of bushing 2 and the surfaces surrounding outlet opening 101. The opposite end of pipe 3 is designed to be connected to the inlet of an ordinary siphon trap, not shown.

Bushing 2 is fitted with a perforated strainer 22 below which a valve seat 5 is formed in main drain pipe 3 for a pop-up stopper 6 having a central push rod 66. Coupled to stopper 6 is a control lever 7 which is mounted in a lateral opening and is sealed therein by union 8 on pipe 3. A suitable actuation device, not shown, is coupled to the end of the lever.

Located on pipe 3, respectively above and below valve seat 5, are two lateral openings 9 and 10, to which is connected a secondary drain pipe 11. Drain pipe 11 comprises two hollow cylindrical elements bent at right angles, indicated as 110 and 111 respectively, as well as a hollow cylindrical element 112 shaped like an inverted "U", the curved part of which is placed at a level above drain hole 101, but below the upper rim of fixture 1. The horizontal arms of elements 110 and 111 are telescopically received into openings 9, 10, and are mounted therein by flange nuts 12 fitted with gaskets to form a watertight seal. The vertical arms of elements 110 and 111 are inserted into the ends of element 112. The latter is also provided with suitable lock nuts 13 fitted with gaskets. The height of element 112, relative to the rim of fixture 1, can be adjusted in such a way as to establish, during installation of the invention, the maximum water level to which fixture 1 can be filled.

When stopper 6 is open, water passes directly through drain bushing 2 through the main pipe 3. When stopper 6 is closed, as shown in FIG. 1, and when the water level in fixture 1 exceeds the level of the lower bend of element 112, the excess water drains off through secondary pipe 11, bypasses stopper 6 and enters drain pipe 3 through lateral opening 10.

It is understood that the invention is not limited solely to the embodiment shown and described but, rather, includes all technical equivalents of the aforesaid means, along with combinations thereof, if implemented in the context of the Claims. Thus, for example, the same results are obtained if secondary drain pipe 11 consists of a length of flexible tube fitted with terminal attachments, which will be shaped as needed after the invention has been applied to the corresponding fitting.

It is claimed:

1. A drain assembly for a sanitary fixture having a drain outlet opening comprising a main drain pipe coupled at one end to the drain outlet opening of said sanitary fixture and having a second end, a stopper positioned in said drain pipe and movable between a first position where said second end of said drain pipe is closed off to said drain outlet opening through said stopper and a second position where said second end of said drain pipe is open to said drain outlet opening, said drain pipe having a first lateral opening positioned above said stopper when said stopper is in its first position and a second lateral opening positioned below said stopper proximate said second end of said drain pipe, a conduit coupling said first opening in said drain pipe to said second opening in said drain pipe, said conduit extending outwardly from said first lateral opening and then bending upwardly in a direction essentially perpendicular thereto, having an inverted U-shaped section proximate said sanitary fixture, and the extending downwardly from said U-shaped section and then bending inwardly in a direction essentially perpendicular therto to said second opening, said U-shaped section being positioned above the drain outlet opening of said sanitary fixture so that when said stopper is in its first closed position, excess liquid in said sanitary fixture will drain through said first opening then through said conduit then into said second opening to drain through said second end of said drain pipe, and adjustment means for permitting adjustment of the height of said U-shaped section relative to said sanitary fixture to permit adjustment of the maximum level of liquid in said sanitary fixture when said stopper is in its first position, said adjustment means including said U-shaped section of said conduit being movable up and down relative to the conduit sections extending from said first and second openings, said U-shaped section being a separate conduit having legs slidably received on the conduit sections extending from said first and second openings, and locking means for releaseably locking said legs on said conduit sections, said stopper including a control lever coupled to said stopper and extending intermediate said first and second lateral openings to move said stopper between its first and second positions.

* * * * *